United States Patent [19]

Kulabukhov et al.

[11] 4,155,704

[45] May 22, 1979

[54] APPARATUS FOR FEEDING A MIXTURE OF STEAM, GAS AND AIR INTO A ROTARY KILN UNDER THE LAYER OF THE MATERIAL PROCESSED

[75] Inventors: Vadim A. Kulabukhov, Moscow; Valentin V. Sheludko, Podolsk Moskovskoi; Nikolai I. Ferens, Moscow; Boris I. Nudelman, Tashkent; Valery G. Volkov, Podolsk Moskovskoi, all of U.S.S.R.

[73] Assignee: Gosudarstvenny Vsesojusny Nauchno-Issledovatelsky Institut Tsementnoi Promyshlennosti Niitsement, U.S.S.R.

[21] Appl. No.: 806,538

[22] Filed: Jun. 14, 1977

[30] Foreign Application Priority Data

Jun. 17, 1976 [SU] U.S.S.R. ..... 2372843

[51] Int. Cl.[2] ..... F27B 7/36

[52] U.S. Cl. ..... 432/105; 431/153; 239/417

[58] Field of Search ..... 432/103, 105, 107, 111, 432/112, 114; 431/153, 187, 188, 189; 239/416, 416.3, 417, 417.4, 430

[56] References Cited

U.S. PATENT DOCUMENTS

| | | | |
|---|---|---|---|
| 1,434,238 | 10/1922 | Weber | 239/417 |
| 2,063,233 | 12/1936 | Debuch | 432/105 |
| 2,368,178 | 1/1945 | Turpin | 431/153 |
| 3,615,053 | 10/1971 | Pease et al. | 239/417 |
| 4,052,151 | 10/1977 | Reichrt | 432/112 |

*Primary Examiner*—Louis J. Casaregola

*Attorney, Agent, or Firm*—Robert E. Burns; Emmanuel J. Lobato; Bruce L. Adams

[57] ABSTRACT

A specific feature of the disclosed apparatus comprising burners disposed along the generatrix of the shell of the kiln and provided each with a plurality of nozzles each whereof is located in the refractory lining of the kiln, consists of a cylindrical portion the outlet wherefrom is provided in the form of converging as well as diverging cones and accommodates an axially disposed hollow movable rod which is provided with perforations within a portion passing through a gas chamber and is linked up with a drive by way of a means of actuation is that the gas chamber is fixed outside the nozzle the cylindrical portion, the converging cone and the diverging one whereof are located coaxially and successively looking in the direction wherein the mixture of steam, gas and air flows, the rod is spring-loaded in the axial direction and provided at its end facing the outlet from the nozzle with a hollow valve head pierced with through passages to obtain communication with the space inside the cylindrical portion of the nozzle and is shaped so that it comes abutting against the wall forming the converging cone, plugging thus the outlet from the nozzle when the rod is set by the drive into its topmost position through the intermediary of a flexible member which is a part of the means of actuation.

3 Claims, 3 Drawing Figures

APPARATUS FOR FEEDING A MIXTURE OF STEAM, GAS AND AIR INTO A ROTARY KILN UNDER THE LAYER OF THE MATERIAL PROCESSED

BACKGROUND OF THE INVENTION

The present invention relates to apparatus for feeding a mixture of steam, gas and air into a rotary kiln under the layer of the material processed, and more specifically into a cement kiln in order to remove, for example, chlorides from the sinter obtained in carrying out the process when these compounds were added to the stock before the sintering thereof or alternatively, to calcinate the sinter in the calcination zone, a mixture of gas and air with steam or without being used in this latter case. The invention may also find utility in the metallurgical and chemical industries as a means of introducing a mixture of gas and air or that of steam, gas and air under the layer of material which must be heat-treated within just one of the process zones a rotary kiln, a drying oven or a cooler for bulk material is subdivided into along its length. In addition, the invention can be used for feeding a mixture of gas and air under the layer of material in stationary equipment for the fluidized-bed treatment of bulk materials.

There is known an apparatus for feeding a mixture of gas and air into a rotary kiln under a layer of material comprising burners which are disposed along the generatrix of the shell of the kiln and admitted into the body whereof is air or a mixture of air and steam. Each burner is provided with a plurality of nozzles wherein the gas is intermixed with the air or steam-air mixture. Each nozzle of each burner is located in the refractory lining of the kiln, consists of a cylindrical portion the outlet wherefrom is provided in the form of converging and diverging cones and accommodates an axially disposed hollow movable rod which is provided with perforations within a portion passing through a gas chamber. The rod is movably linked up with a means of actuation which causes the rod to reciprocate in accordance with a preset programme. The converging and diverging cones are each shaped flat and located in planes running at right angles to each other so that a rectangular slot is formed within the entire length of the outlet from the nozzle. A rake for clearing the slot from granules of material is provided at the end of the rod and extends into the space inside the converging and diverging cones. The gas chamber wherefrom the gas is admitted into the rod is provided inside the nozzle at the inlet therein. All the rods are attached to a common tie beam which is one of the components comprising the means of actuation which causes the rods to reciprocate.

A disadvantage inherent in such an apparatus for feeding a mixture of steam, gas and air into a rotary kiln under the layer of the material processed is that fragments of this material fall down the bodies of those nozzles which are under the layer when the pressure applied to the nozzles ceases to exist due to an interruption in the operation of the draught and blast equipment. The fragments can damage components transmitting the motion from the means of actuation to the rods of the nozzles. The rake each of the perforated rods is provided with is not always capable of clearing the nozzle outlet from fragments of the material. Moreover, if this rake is not centered accurately, the nozzle outlet can be damaged with the sharp edges of the rake with the result that way is opened to more fragments entering the outlet and blocking same as the kiln goes on rotating. The gas outlets provided under the rakes are also likely to be clogged with the material and the same applies to the clearance between each rod and the gas chamber, for neither of these passages is provided with some kind of sealing against the ingress of the spilled material as this shuttles back and forth.

Another disadvantage of the known apparatus is unsatisfactory mixing of the gas with the air in the nozzles, a further disadvantage is damage of the mechanism for cleaning the burners, should one of the rods get stuck in the nozzle, and still another disadvantage is protracted period of starting up the kiln, i.e., the period during which the kiln reaches a steady-state condition. The point is that warming up of the feed to between 650° and 750° C. is required before gas can be admitted into the burners but this temperature is difficult to achieve because the material is cooled by the cold air fed through the burners in great amounts to keep their nozzles unclogged. As a result, the starting-up lasts twice as long as this is commonly the case.

One more disadvantage to be mentioned is the cooling of the leading and trailing portions of the segment the layer of material is shaped like, for cold air is to be admitted into the burners before these enter the layer and after they leave same to prevent any material from falling down the bodies of nozzles, and the gas is admitted only when the layer of material overlaying the burners is between 100 and 300 mm deep or otherwise no complete combustion is obtainable.

SUMMARY OF THE INVENTION

The main object of the present invention is to provide an apparatus for feeding a mixture of steam, gas and air into a rotary kiln under the layer of the material processed wherein the heat exchange between the material and the heat carrier is ensured to proceed at a high rate as a gaseous fluid is being fed under the layer of the material processed.

Another object of the present invention is to prevent the clogging of the spaces inside burners and perforations as well as passages in the rods by the material and to prevent the sticking of rods.

A further object of the present invention is to enhance the wear resistance of the plug attached to the end of each rod and to enable the material to dump unobstructed from a nozzle when this leaves the layer of material in the kiln.

Also regard as an object of the invention is to provide a simple and reliable system of controlling the operation of the burners.

Still another object of the present invention is to assure that those burners which operate under the layer of the material processed are rendered limber for functioning within a brief interval when these burners are provided in the calcination zone of a rotary kiln.

Said and other objects are attained by the fact that in an apparatus for feeding a mixture of steam, gas and air into a rotary kiln under the layer of the material processed comprising burners disposed along the generatrix of the shell of the kiln and provided each with a plurality of nozzles each whereof is located in the refractory lining of the kiln, consists of a cylindrical portion, a converging cone as well as of a diverging cone and accommodates an axially disposed hollow movable rod which is provided with perforations within a portion passing through a gas chamber and is linked up with a drive by way of a means of actuation, in accordance with the invention, the gas chamber is fixed outside the nozzle the cylindrical portion, the converging cone and the diverging cone whereof are located coaxially and successively—looking in the direction wherein the mixture of steam, gas and air flows, the rod is spring-loaded in the axial direction and provided at its end facing the outlet from the nozzle with a hollow plug or valve head pierced with through passages to obtain communication with the space inside the cylindrical portion of the nozzle and is shaped so that it comes abutting against the wall forming the converging cone, plugging thus the outlet from the nozzle when the rod is set by the drive into its topmost position through the intermediary of a flexible member which is a part of the means of actuation.

The gas chamber can be attached to the body of the burner and provided with an outward spring retainer while the rod can be provided with an inward spring retainer.

It is preferred that the spring exerting its action on the rod is fitted coaxially with the rod between the outward spring retainer of the gas chamber and the inward spring retainer of the rod.

It is also preferred that the hollow plug is provided with an annular groove of triangular cross section so that its first side-looking in the direction wherein the mixture of steam, gas and air flows—forms an angle between 15 and 90 deg. with the axis of the plug and that the passages are provided in the second side—looking in the direction wherein the mixture of steam, gas and air flows—so that their direction is parallel to the first side.

It is further preferred that the end of the plug extending into the diverging cone is provided with a projection in the form of a truncated cone with through passages running radially at the greater base thereof and communicating with the space inside the plug.

The essence of the invention is as follows. The fact that the gas chamber is fixed outside the nozzle, the cylindrical portion of each nozzle along with the converging and diverging cones are arranged coaxially and successively—looking in the direction wherein the mixture of steam, gas and air flows—ensures a thorough mixing of the gaseous fluids and a tight plugging of the outlet from the nozzle so that no material can fall down the body of a burner. In addition, any material which might have entered the burner by accident drops back into the kiln with no obstruction. The hollow plug or valve head which is provided at the end of the rod, pierced with through passages communicating with the space inside the cylindrical portion of the nozzle and shaped so as to come abutting against the wall forming the converging cone when the rod is set into its topmost position serves itself as a reliable means of plugging the outlet from the nozzle, but the fact the rod is spring-loaded in the axial direction adds to the reliability of plugging. The through passages the hollow plug is provided with ensure the feeding of the gaseous fluids from the space inside the rod into the space inside the nozzle and provide for good cooling of both the plug and the outlet from the nozzle. The linking up of the rod with the drive through a flexible member which is a component of the means of actuation provides for normal functioning of the rest of the rods in a burner should one of the rods become damaged.

By virtue of attaching the gas chamber to the body of the burner a reliable seal is provided between the rod and the gas chamber.

By fitting coaxially the spring exerting its action on the rod, it is ensured that the rod moves during its back-stroke precisely along the axis of the nozzle so that any sticking of the rod in the seals of the gas chamber is prevented.

By providing the outward spring retainer on the gas chamber and the inward spring retainer on the rod, the functioning of the spring in a reliable way is ensured along with the possibility of adjusting the force pressing the plug of the rod to the wall of the converging cone.

On the grounds that the hollow plug or valve head is provided with an annular groove of triangular cross section so that its first side—looking in the direction wherein the mixture of steam, gas and air flows—forms an angle between 15 and 90 deg. with the axis of the plug and that the passages are provided in the second side—looking in the direction wherein the mixture of steam, gas and aid flows—so that their direction is parallel to the first side, a reliable protection of the passages against the ingress of fragments of the material is fully ensured.

By providing the end of the plug extending into the diverging cone with a projection in the form of a truncated cone with through passages running radially at the greater base thereof and communicating with the space inside the plug, it is ensured that the gaseous fluid is uniformly distributed through the layer of the material and the surface of the plug is given protection against abrasive wear brought about by particles of the material processed.

To obtain a better understanding of the essence of the invention, drawings of a specific embodiment thereof showing an apparatus for feeding a mixture of steam, gas and air into a rotary kiln under the layer of the material processed according to the invention are appended to the description, and in these drawings:

DESCRIPTION OF THE PREFERRED EMBODIMENT

Figure 1:
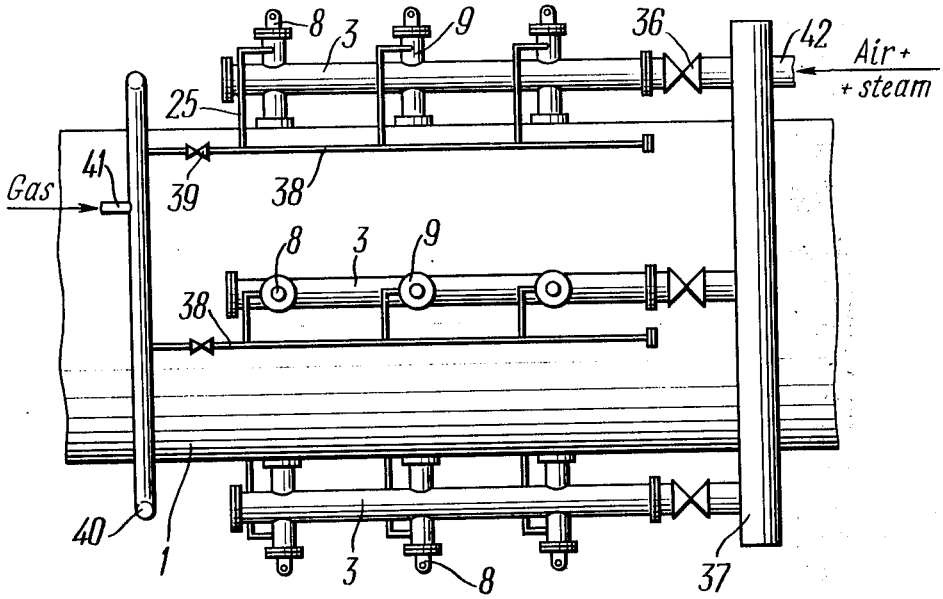
FIG. 1 is a schematic side elevation of a length of a rotary kiln fitted with burners each whereof consists of a plurality of nozzles; the means of actuating the rods along with the drive proper are not shown.
Figure 2:
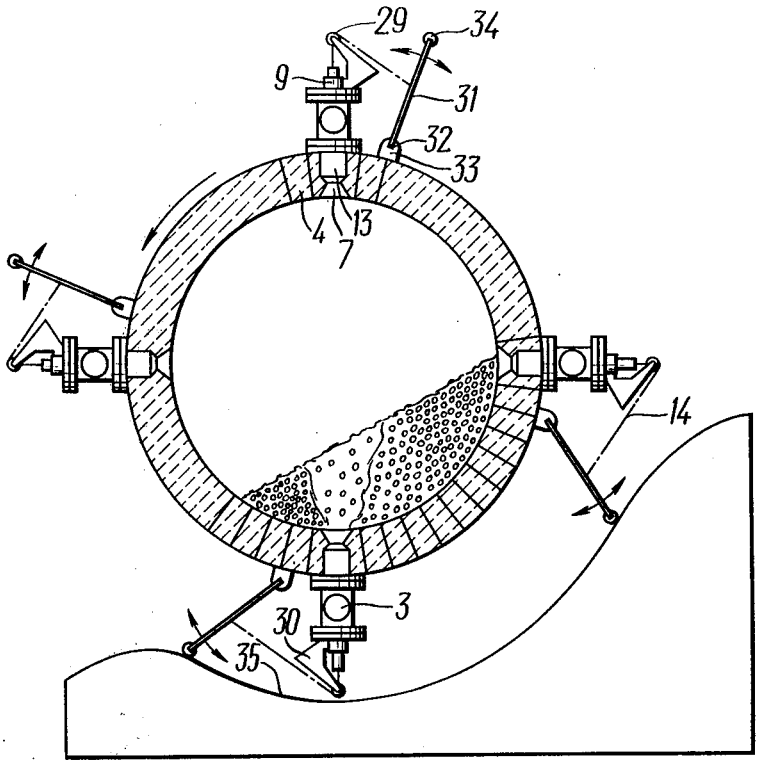
FIG. 2 is a schematic cross section of the rotary kiln at the place where burners—each with a plurality of nozzles—are installed, showing only four burners out of the total of twelve disposed all the way along the circumference of the shell of the kiln and also the lower tracer serving to actuate the rods of the nozzles as well as the layer of the material inside the kiln (the upper tracer is not shown)
Figure 3:
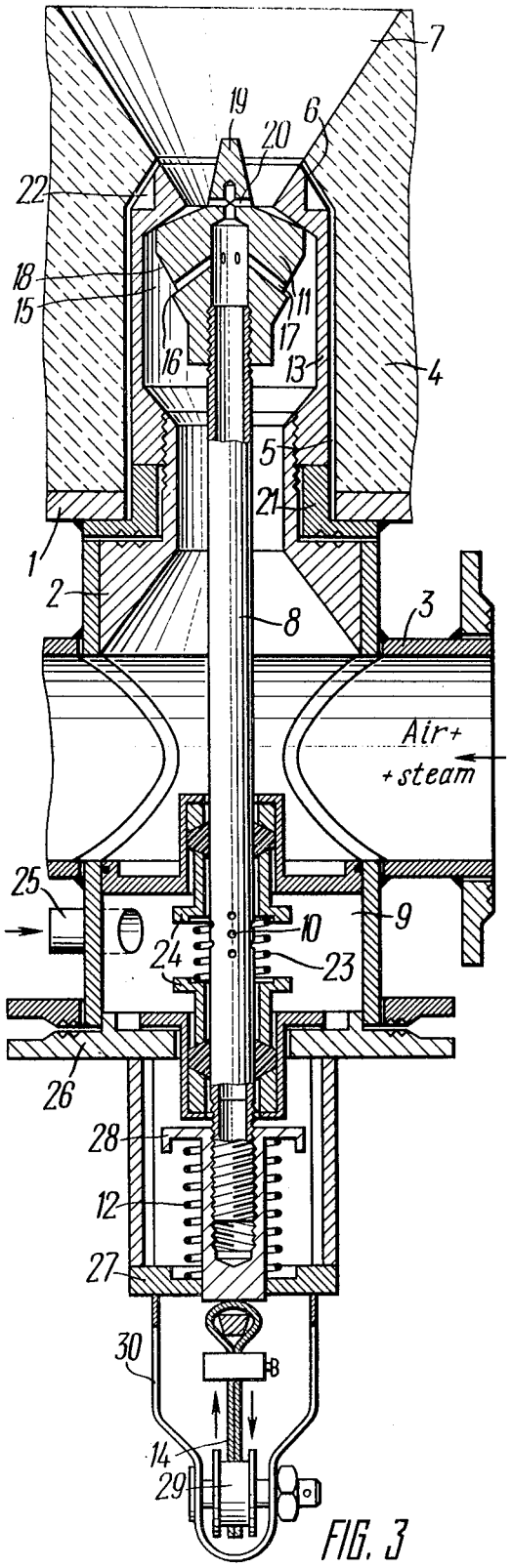
FIG. 3 is a sectional elevation of a nozzle showing a portion of the body of a burner and that of the rotary kiln with the lining, also in cross section.

Referring to the drawings, the apparatus for feeding a mixture of steam, gas and air into a rotary kiln under the layer of the material processed comprises burners each body 3 whereof is attached to a shell 1 of the rotary kiln through the intermediary of nozzles 2. The length of each nozzle 2 passing through a refractory lining 4 in fashioned brick consists of a cylindrical portion 5 which turns into a converging cone 6—if looked in the direction wherein the mixture of steam, gas and air flows—followed by a diverging cone 7. A hollow movable rod 8 is provided along the axis of the nozzle 2. Attached to the body 3 of the burner is a gas chamber 9 located coaxially with the rod 8 at that place where perforations 10 are provided in the rod 8. A hollow valve head a plug 11 which is a solid of revolution in refractory steel is attached to the rod 8 and contained in the space formed by the cylindrical portion 5, the converging cone 6 and the diverging cone 7. A spring 12 fitted coaxially with the rod 8 causes the plug 11 of the rod 8 to firmly abut the wall of the converging cone 6. A reinforcing sleeve 13 is embedded into the refractory lining 4 so that it contains the space formed by the cylindrical portion 5, the converging cone 6 and the diverging cone 7. Attached to the end of the rod 8 extending outside the gas chamber 9 is a flexible member 14 of the means of actuation linking up the rod 8 with a drive which imparts reciprocative motion thereto. In the preferred embodiment of the invention, the flexible member is a wire fastened to the end of the rod 8. That portion of the plug 11 of the rod 8 which works in the space contained by the reinforcing sleeve 13 is provided with an annular groove 15 of triangular cross section, the first side 16 whereof—looking in the direction wherein the mixture of steam, gas and air flows—forms an angle of between 15 and 90 deg. with the axis of the plug 11. Passages 17 of the plug 11 are provided in the second side 18, locking in the direction wherein the mixture of steam, gas and air flows. The angle whereat the passages 17 are inclined relative to the axis of the rod 8 is equal to the angle of inclination of the first side 16. The surface of the plug 11 working inside the diverging cone 7 and in contact with the working space of the rotary kiln is provided with a projection 19 in the form of a truncated cone with radial through passages 20. The walls of the reinforcing sleeve 13 in a refractory steel are thickening towards the bottom where a female threed is provided for by means whereof the sleeve 13 is attached to inlet portion of the nozzle 2, flats 22 for applying a socket wrench being provided to that end on the sleeve 13. The inlet portion of each nozzle 2 is rigidly attached to the body 3 of the burner and this body tightly fits the shell 1 of the rotary kiln due to the presence of an adapter 21 welded to the shell 1 and provided with a gasket ring. A packing spring 23 slipped on the rod 8 around that portion thereof which is provided with the perforations 10 for feeding the gas inside the rod 8 is interposed between glands 24 of the seals between the rod and the gas chamber 9 inside same. The gas chamber 9 is provided with a pipe 25 at its side fed wherethrough is the gas, and attached to an end face plate 26 of the chamber 9 is an outward spring retainer 27 which, in conjunction with an inward spring retainer 28 threadedly attached to the rod 8, holds a spring 12 in compressed condition. The wire (flexible member) 14 is attached to the end of the rod 8 through the intermediary of a clamp the inward spring retainer 28 is provided with and passed through a guide pulley 29 supported by a bracket 30, the guide pulley being so located that the length of the wire 14 between the rod 8 and the pulley 29 coincides with the axis of the rod 8. The other end of the wire 14 is attached, for example, to a lever 31 held fast to the shell I of the rotary kiln by means of a fulcrum pin 32 and a rigidly-attached bracket I. The lever 31 is provided with a roller 34 contacting, when the kiln is rotating, a guide 35 installed so that interacting therewith are only the rollers of those lever which are associated with the nozzles overlaid with the layer of the material processed.

The bodies 3 of all burners are connected to annular headers 37 through valves 36 admitted wherethrough is a mixture of steam and air or just air. Running parallel to the bodies 3 of the burners there are longitudinal gas headers 38 connected to annular gas headers 40 through valves 39, and the longitudinal gas headers are connected to the gas chambers 9 by means of the pipes 25. The annular gas headers and the air headers are connected by pipes 41 and 42, respectively, to the means of supplying gas, water and air to the rotary kiln from stationary plant lines.

The apparatus for feeding a mixture of steam, gas and air into a rotary kiln under the layer of the material processed operates on the following lines. The rotary kiln is started up in the usual way by setting into operation the end burner wherethrough is admitted the fuel. When cement clinker is sintered from a stock added whereto are chlorides, the stock can be introduced into the feed end of the kiln in the form of a slurry, dry pulverous material or granules. Travelling down the kiln in a countercurrent flow with the chimney gases, the stock passes through the zones of drying, heating up, calcination and sintering at temperatures varying over the range between 900° and 1200° C. depending on the composition of the stock, and reaches the discharge end of the rotary kiln where the burners are installed. During the starting-up period, the guide 35 is inoperative, exerting no action on any of the rods 8 through the intermediary of the roller 34, the lever 31 and the flexible member (wire) 14. At this stage, the plug 11 is in tight contact with the slanting surface of the converging cone 6, i.e., with the converging cone 6 of the reinforcing sleeve 13 in the preferred embodiment, due to the action of the spring 12 compressed by the outward spring retainer 27 at one end and by the inward spring retainer 28 at the other end, this latter retainer actually transmitting the spring action to the rod 8. A pressure applied to the nozzles 2 below the plugs 11 by admitting air in small amounts into the body 3 of each burner from the header 42 through the valves 36 keeps the finely-pulverizied particles of the material processed out of the nozzles 2 and the bodies 3 of the burners, cooling also to some extent the sides of the plugs 11 in contact with the nozzles 2 as well as the surfaces of plugs facing the interior of the kiln. In addition, air enters inside each of the plugs 11 by way of the through passages 17 and leaves in small amounts into the kiln through the radial passages 20, forming an air screen in the space above each plug 11 at the base of each diverging cone 7. Being located at the entry into the diverging cone 7, i.e., embedded into the lining 4 of the kiln, the plug 11 and the sleeve 13 are heated by convection not as much as by radiation and due to the contact with the material which is heated to between 900° and 1200° C. before the mixture of steam, gas and air is fed into the nozzle 2. Tests have proved that the temperature of the plug is between 200° and 380° C. when that of the layer of material is 1000° to 1200° C. and cold air is being drawn therethrough at a rate of 10 $m^3/h$. The temperature of the projection 19, the height whereof is between 0.3 and 0.5 of the height of the plug 11, is between 580° and 650° C. at the tip. Since the amount of the air drawn through the layer of material is between 1/15 and 1/20 of the amount drawn in the known apparatus where the outlets from the nozzles remain unplugged, there is only a slight reduction in the temperature of the sinter. As soon as the sinter builds up into a layer of sufficient depth and the temperature reaches a point between 900° and 1200° C., the drive imparting motion to the rods 8 of the nozzles 2, i.e., the guide 35, is rendered operative. As result, a lever 31 starts exerting its action on the flexible member (wire) 14 as soon as the diverging cone is overlaid with a layer of sinter between 50 and 100 mm deep. The roller 34, running against the guide 35, causes the lever 31 to pivot about the fulcrum pin 32 so that the wire 14 is pulled around the roller 29 and compresses the spring 12 between the two spring retainers 27 and 28 in accordance with a preset programme, forcing the rod 8 to separate from the tapered surface of the converging cone 6 with a delay which enables air to pass into the sinter through an annular gap formed between the plug 11 and the sleeve 13. Another tracer (not shown) causes the valve 39 to open, admitting the gas from the headers 40 and 38 into the gas chamber 9 through the pipe 25, and then the gas reaches the space inside the nozzle 2 from the gas chamber 9 through the perforations 10 in the rod 8, the space inside the rod 8 and the passages 17 in the plug 11. Inasmuch as the gas escapes from the passages 17 in a countercurrent flow with the air, the passages 17 being inclined to that effect, the intermixing is a thorough one and the mixture of gas and air is fed into the layer of material with a given air-to-gas ratio. Steam which is required for the intensification of the process of chloride removal is introduced into the layer of material by injecting water into the header 42 wherein it evaporates in the stream of hot air and is transformed into steam. The rate of flow and the head of the mixture of steam, gas and air introduced into the nozzle 2 are selected so that a local fluidized bed of granular sinter is formed above the nozzle. As more nozzles of the burner become overlaid with the layer of material, the plug 11 move farther outward from their converging cones 6, this separation being at its maximum when the depth of the layer is the maximum too. When nozzles leave the deepest part of the layer of material, the guide 35 gradually releases the spring 12 of the rod 8, and the plug 11 starts moving inward toward the converging cone 6 due to the action of the spring 12, coming into contact therewith—or with the converging cone of the sleeve 13 as is the case in the preferred embodiment—at that time when the nozzle is overlaid with the layer between 50 and 100 mm deep. The gas is cut off somewhat in advance of the plugging of the nozzle 2 by the plug 11 so that the body 3 of the burner and the nozzles are blown through with air and steam to prevent the possibility of an explosion of the apparatus. The fact that plugged are all nozzles overlaid with a thin layer of material and those not overlaid at all reduces the consumption of compressed air and improves both the aerodynamics and performance of nozzles. The plugging of nozzles prevents the clogging thereof with finely dispersed material and also the clogging of burner bodies. Should, however, some material enter the body 3 of a burner, it can be easily removed by blowing the body 3 and its nozzles 2 when these are in their topmost position in the kiln and lock downward. A tracer (not shown) is employed which causes the respective plugs 11 to move outward from their converging cones 6 so that the particles of sinter contained in the body 3 roll down into nozzles and are expelled therefrom into the kiln with a blast of compressed air. Such blowing of nozzles is repeated from time to time by setting the blowing guide into operation. No material blown from nozzles can enter passages 17 and block same or enter the space inside the rod 8 and block perforations 10 because the material is deflected from the projection of the plug 11 made before the annular groove 15.

The first side 16—looking in the direction wherein the mixture of steam, gas and air flows—which forms an angle between 15 and 90 deg. With the axis of the plug 11 also prevents the material from entering the passages 17.

The female thread each of the sleeves 13 is provided with at its cylindrical portion ensures the attachment of the bodies 3 of burners to the shell of the kiln and extends the service life of the lining 4 made in fashioned bricks. The material of both the sleeve 13 and the plug 11 is refractory steel capable of withstanding working temperature over 1400° C. in the kiln, and the ratio of the height of the sleeve 13 to the thickness of the lining 4 changes inversely with the temperature in the kiln. So, if the temperature is 1400° C., the height of the sleeve is roughly ½ of the thickness of the lining and at the temperature of 900° C. this height may increase to the depth of the lining.

In addition to the slanting passages 17 in each of the plugs 11, which provide for thorough intermixing of the gas and air, serving the same purpose is the converging cone 6 provided at the outlet from each nozzle 2. Another function of the converging cone 6 is to provide for the plugging of the nozzle 2 by ensuring a tight contact of its tapered surface with the plug 11. The diverging cone 7 following after the converging one provides for an unobstructed discharge of the material processed from the outlet of the nozzle, serves to distribute the mixture of steam, gas and air over the layer in a uniform way and facilitates the ignition of this mixture when it comes into contact with the red-hot walls. The projection 19 of the plug 11 assists the diverging cone 7 in performing its positive functions and, in addition, protects the end face of the plug 11 against abrasive wear induced by particles in the layer of material.

When the apparatus disclosed is employed to remove chlorides from the sinter, the process goes on as follows. The steam formed during the combustion of the mixture of gas and air in the layer of sinter comes into lively contact with the granules, removing the chlorides contained in the sinter. The chlorine liberated mixes up with the chimney gases. The reactions taking place in the layer of sinter are endothermic ones, and the gas is fed into the layer in a calculated amount so that the process of chloride removal is accomplished with a priod between 5 and 15 min. at the temperature of sintering. The steam resulting from the combustion of this quantity of gas is obtained in an amount sufficient for the process of chloride removal to be carried out, yet additional steam is being introduced into the layer for the purpose of intensifying the process as pointed out hereinabove. The treatment of the sinter in the zone of burners yields quality clinker with all the requisite properties.

The disclosed apparatus holds out a special promise as a means of intensifying the process of calcination of the stock in a rotary kiln. The burners are installed within that length of the kiln which corresponds to the calcination zone, and the mixture of steam, gas and air is introduced into the layer of material when its depth is at least 50 mm and the temperature between 650° and 700° C., i.e., sufficiently high to enable the ignition of the mixture. The burners are started up, in contrast to the known apparatus, within a short period of time because air is fed into the layer of material in a small amount which cannot cool the material processed before the mixture is being introduced. Since the rates of heat and mass transfer greatly increase in the fluidized bed, the reaction of the calcination of limestone is speeded up too. The possibility of skull formation is low in the rotary kiln compared with stationary fluidized-bed equipment of the waste-heat type where the gas temperature is never above 950° C. and, consequently, there is a practical possibility to rise the temperature in the layer of the material processed in the rotary kiln to between 1100° and 1250° C. At temperatures of this order the rate of calcination sharply increases. If burned in the layer are 20% of the total fuel required for sintering clinker, the length of the calcination zone is reduced to between 1/7 and 1/10 of the length commonly used.

Test data acquired so far indicate that by using the apparatus disclosed the rate of throughput of the kiln can be boosted by between 20 and 200%. Yet, practically feasible is an increase in the rate of throughput between 25 and 40%, for the optimum amount of fuel burned within the length of the zone of calcination is anywhere between 20 and 30% of the total amount. An increase in the amount burned beyond this limit is achievable by using a sophisticated apparatus which appears to be economically unsound. By burning some of the fuel in the zone of calcination, the thermal stresses the sintering zone is exposed to are reduced with the result that the service life of the lining is increased by half as much again or even two-fold. Also a reduction of the losses into the surrounding is registered—a factor contributing to a decrease in the specific fuel consumption during the process of burning.

The apparatus disclosed is in fact one of the main units of a rotary calcinator built into the kiln which, unlike the waste-heat calcinators, can be incorporated into an operating kiln during a major overhaul thereof without introducing any basic changes into the waste-heat means of pretreating the stock. A less elaborate version of the disclosed apparatus can be used for feeding only air into the layer of clinker providing for an effective cooling thereof in the fluidized beds. Such an apparatus can be installed either at the discharge end of the kiln or given the form of a separate shell which is a continuation of the kiln and functions as the cooler.

As it will be inferred from the description, the apparatus disclosed ensures a trouble-free feeding of a mixture of steam, gas and air under the layer of the material processed in a rotary kiln, speeds up the rate of heat and mass transfer in the layer, is of a dependable and simple construction.

What is claimed is:

1. A kiln comprising, a rotary kiln having a refractory lining, burners disposed spaced circumferentially about said rotary kiln, each burner comprising a cylindrical axial portion terminating in a chamber having a nozzle constituting a converging cone portion in communication with said cylindrical axial portion chamber and a diverging cone portion, a tubular rod extending axially in said cylindrical axial portion, a valve head on said tubular rod in said chamber having surfaces seatable on said converging cone portion closing the nozzle, means biasing the rod axially to seat said valve head, means externally of the rotary kiln for selectively unseating said valve head, means for feeding air or steam and air into said cylindrical portion for delivery into said chamber and into said kiln when said valve head is unseated, said valve head having passageways providing communication between the tubular rod and said chamber for delivery of a gaseous fuel into said chamber selectively independently of delivery of said air and steam or a mixture thereof and for delivery of said fuel simultaneously with said air or air and steam mixture.

2. A kiln according to claim 1, in which said means for selectively unseating said valve head comprises means rendered effective only when a given volume of sinter material in said rotary kiln overlies said nozzle.

3. A kiln according to claim 1, in which said lining has conical hollows defining a continuation of the diverging cone portion of each nozzle.

* * * * *